US008866728B2

(12) United States Patent
Sano et al.

(10) Patent No.: US 8,866,728 B2
(45) Date of Patent: Oct. 21, 2014

(54) LIQUID CRYSTAL DISPLAY

(75) Inventors: Yuma Sano, Kawasaki (JP); Ryosuke Nonaka, Yokohama (JP); Masahiro Baba, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 402 days.

(21) Appl. No.: 13/218,641

(22) Filed: Aug. 26, 2011

(65) Prior Publication Data

US 2012/0057084 A1 Mar. 8, 2012

(30) Foreign Application Priority Data

Sep. 3, 2010 (JP) ..... 2010-197963

(51) Int. Cl.
*G09G 3/36* (2006.01)
*G09G 3/34* (2006.01)

(52) U.S. Cl.
CPC ..... *G09G 3/3611* (2013.01); *G09G 2360/16* (2013.01); *G09G 2320/0276* (2013.01); *G09G 3/3426* (2013.01); *G09G 2320/0646* (2013.01)
USPC ..... 345/102; 345/87; 345/89; 349/6

(58) Field of Classification Search
USPC ..... 345/87–100, 102, 690; 349/1, 5, 6; 362/611, 612
See application file for complete search history.

(56) References Cited

U.S. PATENT DOCUMENTS

2006/0214904 A1* 9/2006 Kimura et al. ..... 345/102
2009/0213145 A1* 8/2009 Onizawa ..... 345/690
2009/0289890 A1* 11/2009 Tsuchida et al. ..... 345/102
2011/0169873 A1 7/2011 Sano et al.
2012/0026208 A1 2/2012 Kobiki et al.

FOREIGN PATENT DOCUMENTS

| | | |
|---|---|---|
| JP | 2004-325628 | 11/2004 |
| JP | 2006-129105 | 5/2006 |
| JP | 2008-203292 | 9/2008 |
| JP | 2009-180934 | 8/2009 |
| JP | 2010-152174 | 7/2010 |

OTHER PUBLICATIONS

Japanese Office Action mailed May 29, 2012 for Japanese Application No. 2010-197963.

* cited by examiner

*Primary Examiner* — Kimnhung Nguyen
(74) *Attorney, Agent, or Firm* — Amin, Turocy & Watson, LLP

(57) ABSTRACT

The liquid crystal panel displays a video in a display area by modulating light from the backlight including a plurality of light sources. The luminance value calculator calculates light source luminance values of the light sources based on an input video signal including signal values of pixels. The luminance distribution calculator calculates luminance distribution of light in illumination areas obtained by tentatively dividing the display area if the light sources emit light according to the light source luminance values. The representative value calculator calculates, based on the input video signal, a representative luminance value in each of divided areas obtained by dividing the display area. The signal corrector corrects the input video signal based on the luminance distribution according to a difference between a maximum value of the representative luminance values and an average value of the representative luminance values.

9 Claims, 13 Drawing Sheets

(a) AN EXAMPLE OF DIRECT TYPE BACKLIGHT (b) AN EXAMPLE OF EDGE TYPE BACKLIGHT

LIQUID CRYSTAL DISPLAY

CROSS REFERENCE TO RELATED APPLICATIONS

This application is based upon and claims the benefit of priority from the prior Japanese Patent Application No. 2010-197963, filed on Sep. 3, 2010, the entire contents of which are incorporated herein by reference.

FIELD

The embodiments of the present invention relate to a liquid crystal display including a backlight having a plurality of light sources.

BACKGROUND

Studies on a liquid crystal display have been developed as to the technique for controlling the luminance of light emitted from a backlight in accordance with a video signal, in order to improve the contrast of the video to be displayed and to reduce power consumption.

According to a general method, a screen is divided into a plurality of areas, and the luminance of a light source arranged in each area is separately controlled in accordance with a video signal.

When the luminance of the light sources is reduced as a result of the luminance control, the signal value is expanded to maintain the luminance to be displayed. As a method to reduce gradation saturation caused by this expansion, it is suggested to set an expansion gain smaller as the signal value becomes larger in order to prevent gradation saturation.

However, in the above conventional technique, expansion gains each differing depending on each pixel position must be calculated to calculate a nonlinearly expanded signal value of the input signal value using the expansion gains. Accordingly, there is a problem that computing amount is enormously increased.

DETAILED DESCRIPTION

According to an aspect of the embodiments, there is provided a liquid crystal display, including a backlight, a liquid crystal panel, a luminance value calculator, a luminance distribution calculator, a representative value calculator and a signal corrector.

The backlight has a plurality of light sources, each of the light source being controllable respectively.

The liquid crystal panel is arranged in front of the backlight to display a video in a display area.

The luminance value calculator calculates light source luminance values of the light sources based on an input video signal including signal values of a plurality of pixels.

The luminance distribution calculator calculates luminance distribution of light in illumination areas obtained by tentatively dividing the display area if the light sources emit light according to the light source luminance values.

The representative value calculator calculates, based on the input video signal, a representative luminance value in each of a plurality of divided areas obtained by dividing the display area.

The signal corrector calculates a corrected video signal by correcting the input video signal according to a difference between a maximum value of the representative luminance values and an average value of the representative luminance values.

Hereinafter, first and second embodiments will be explained. Note that components or processes based on a similar operation are given the same symbols, and overlapping explanation will be omitted.

First Embodiment

Figure 1:
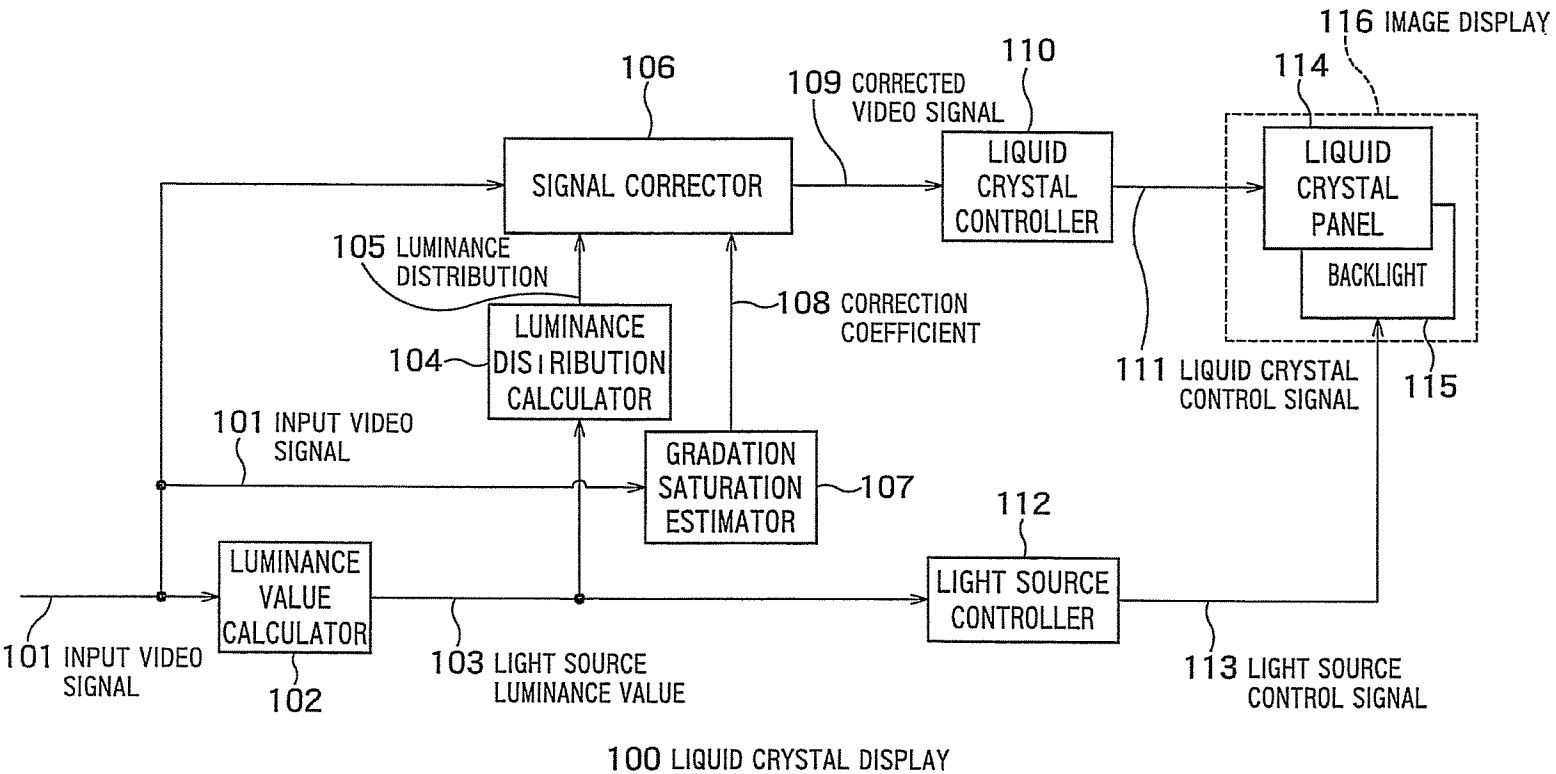
FIG. 1 is a diagram showing a liquid crystal display according to a first embodiment.

FIG. 1 is a diagram showing a liquid crystal display 100 according to the present embodiment.

The liquid crystal display 100 includes: a luminance value calculator 102; a luminance distribution calculator 104; a gradation saturation estimator 107; a signal corrector 106; an image display 116; a light source controller 112; and a liquid crystal controller 110.

The image display 116 has a backlight 115 and a liquid crystal panel 114.

The backlight 115 has a plurality of light sources whose luminance are each controllable independently.

The liquid crystal panel 114 displays an image by modulating the transmittance or reflectance of light from the backlight 115.

Note that the present embodiment will be explained based on an example in which the backlight 115 has a plurality of white light emitting diodes (LED) as the light sources each having separately controllable light intensity.

First, areas obtained by tentatively dividing a display area of the liquid crystal panel 114 based on a spatial arrangement of the light sources in the backlight 115 are defined as illumination areas. That is, the number of illumination areas is the same as the number of light sources, and each illumination area is related to a different light source (in the closest position). The correspondence between the signal value of each pixel in an input video signal 101 and each illumination area is previously defined and stored in the luminance value calculator 102.

The luminance value calculator 102 calculates the luminance value of the light source in each illumination area, depending on the signal value of each pixel in the illumination area. That is, the luminance value calculator 102 performs gamma conversion on the input video signal 101, and calculates a light source luminance value 103 of each illumination area based on the luminance values of the pixels.

The luminance distribution calculator 104 estimates the luminance of light incident on each pixel position of the liquid crystal panel 114 (hereinafter described as luminance distribution 105) when the backlight 115 irradiates light on the liquid crystal panel 114 in accordance with the light source luminance value 103.

The gradation saturation estimator 107 calculates, from the input video signal 101, a correction coefficient 108 used to correct the input video signal by the signal corrector 106.

Figure 2:
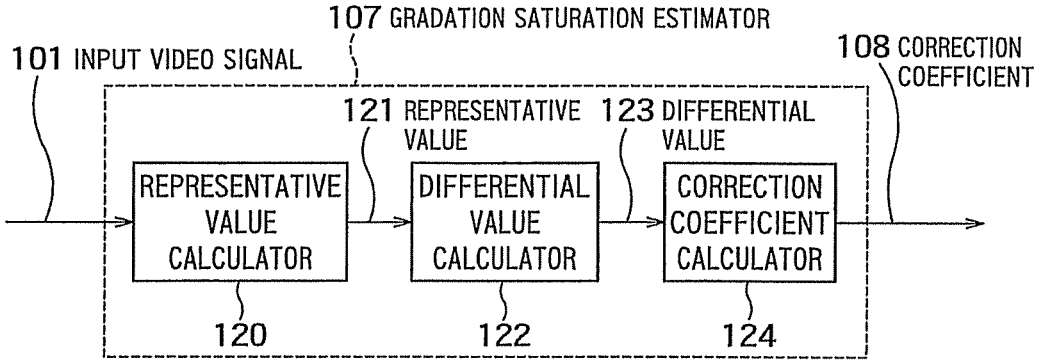
FIG. 2 is a diagram showing the structure of a gradation saturation estimator.

FIG. 2 shows the gradation saturation estimator 107.

The gradation saturation estimator 107 has a representative value calculator 120, a differential value calculator 122, and a correction coefficient calculator 124.

The representative value calculator 120 divides the screen (1 frame) of the input video signal 101 into a plurality of divided areas, and calculates a representative value 121 in each divided area based on the luminance values of the pixels.

The differential value calculator 122 calculates the average value of the representative values of all of the divided areas and specifies the maximum value among the representative values of all of the divided areas, in order to calculate a differential value 123 between the maximum value and the average value. As will be explained later, as the differential value 123 becomes larger, gradation saturation occurs more easily in the input video if the input video signal expanded by the signal corrector 106 is directly displayed.

The correction coefficient calculator 124 calculates the correction coefficient 108 so that its value becomes smaller as the differential value 123 becomes larger, and becomes larger as the differential value 123 becomes smaller. Therefore, the correction coefficient 108 having a large value means that gradation saturation hardly occurs in the input video, and the correction coefficient 108 having a small value means that gradation saturation easily occurs in the input video. In other words, the correction coefficient 108 is an index showing how easily gradation saturation occurs in the input video.

The signal corrector 106 of FIG. 1 calculates a corrected video signal 109 from the input video signal 101, in accordance with the luminance distribution 105 and the correction coefficient 108.

Figure 3:
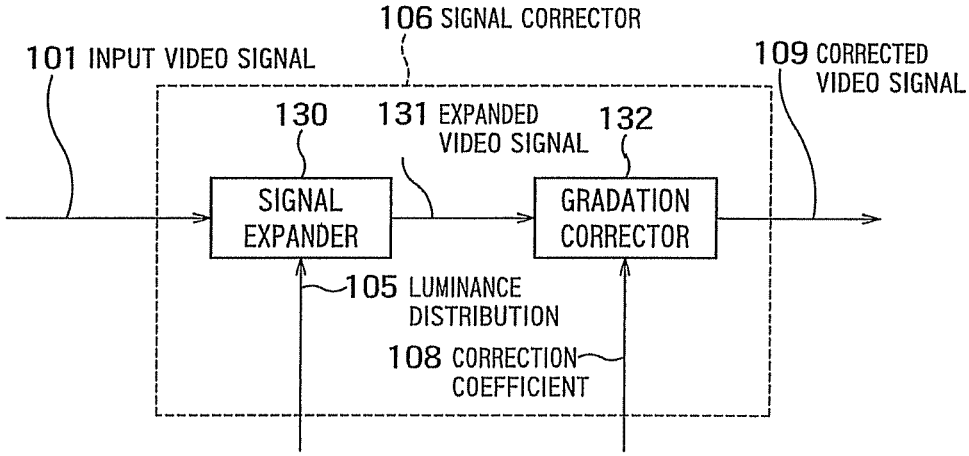
FIG. 3 is a diagram showing the structure of a signal corrector.

FIG. 3 shows the signal corrector 106.

The signal corrector 106 has a signal expander 130 and a gradation corrector 132.

The signal expander 130 calculates an expanded video signal 131 by expanding the input video signal 101 in accordance with the luminance distribution 105.

The gradation corrector 132 calculates the corrected video signal 109 by correcting the expanded video signal 131 in accordance with the correction coefficient 108.

The light source controller 112 of FIG. 1 generates a light source control signal 113 based on the light source luminance value 103 calculated for each light source, and drives the backlight 115 by transmitting the light source luminance control signal 113.

The liquid crystal controller 110 performs control to modulate the liquid crystal panel 114 (the transmittance or reflectance in each pixel) in accordance with the corrected video signal 109.

Figure 4:
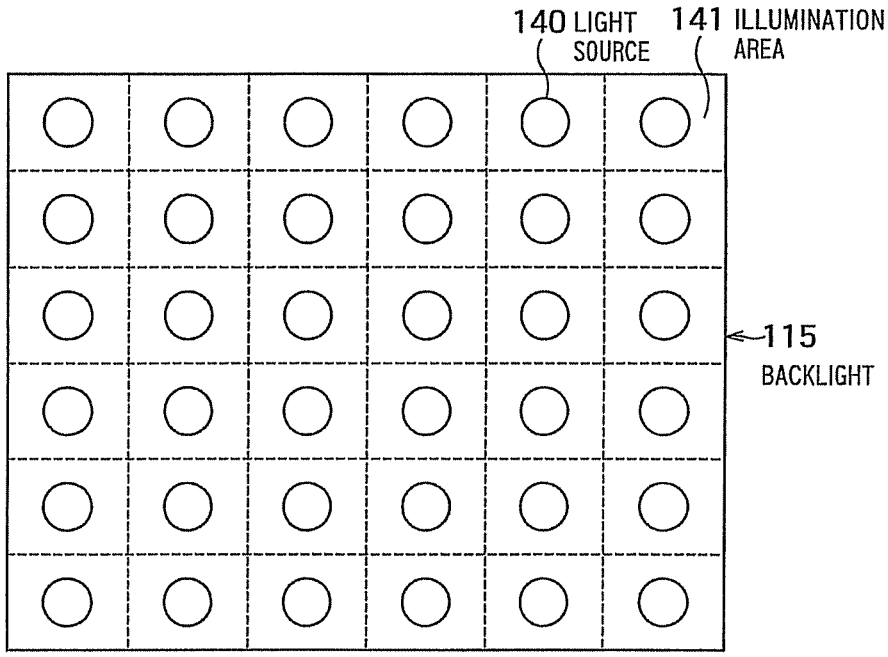
FIG. 4 is a diagram showing a structural example of a backlight.
Figure 4:
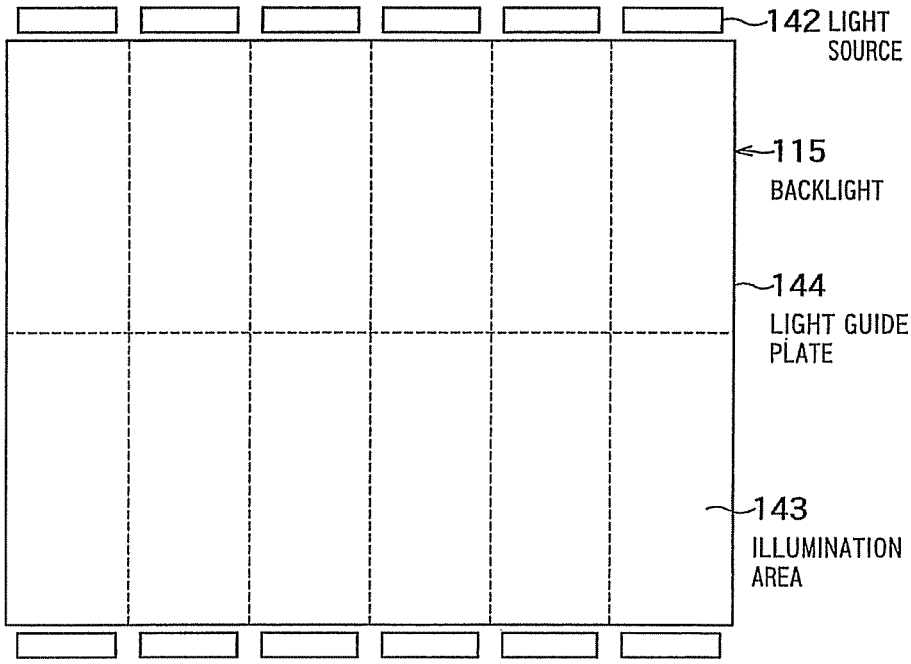

Each of FIG. 4(*a*) and FIG. 4(*b*) is a diagram showing a detailed structural example of the backlight 115.

FIG. 4(*a*) shows an example of a direct type backlight. The backlight 115 includes a plurality of white light sources 140. The light-emitting intensity of each light source can be separately controlled. In the display area, illumination areas 141 are defined corresponding to the white light sources 140 respectively.

FIG. 4(*b*) shows an example of a double-edge type backlight. White light sources 142 are arranged along two edges respectively. The light emitted by the white light sources 142 is guided to the display area by a light guide plate 144. In the display area, illumination areas 143 are defined corresponding to the white light sources 142 respectively.

Note that each of FIG. 4(*a*) and FIG. 4(*b*) shows only one structural example of the backlight, and thus another structure may be employed. For example, white light sources should not necessarily be used as the light sources of the backlight 115, and the backlight 115 may include light sources of two or more kinds of colors.

Next, the operation performed by the liquid crystal display 100 of the present embodiment will be explained in detail.

Figure 5:
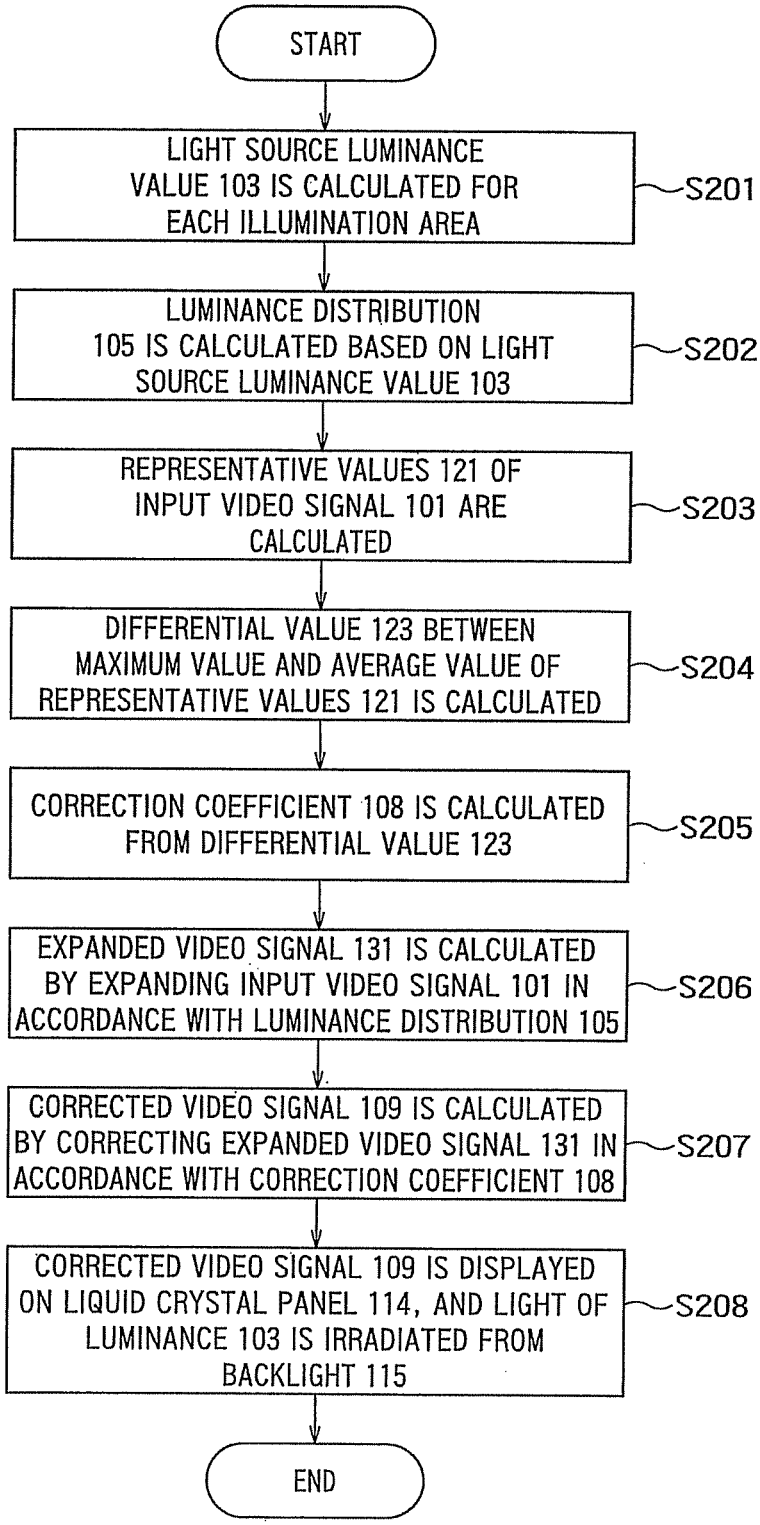
FIG. 5 is a flow chart showing the operation performed by the liquid crystal display of FIG. 1.

FIG. 5 is a flow chart showing the operation performed by the liquid crystal display 100 of the present embodiment.

First, the luminance value calculator 102 obtains $L_{in}$ by performing gamma conversion on the gradation value $S_{in}$ of each of R, G, B subpixels forming each pixel of the input video signal 101, based on Formula (1).

$$L_{in} = \left(\frac{S_{in}}{255}\right)^{\gamma} \tag{1}$$

γ represents a gamma coefficient. The gamma conversion operation may be performed by referring to a previously prepared lookup table determining the correspondence between an input gradation value and its gamma-converted gradation value. The above conversion is performed on each of R, G, B subpixels of every pixel of the input video signal 101.

Next, the luminance value calculator 102 calculates the maximum value among the signal values of R, G, B subpixels forming each pixel of the input video signal 101, and determines the maximum value as the luminance value of each pixel. In the present embodiment, the maximum value among the R, G, B signal values is determined as the luminance value of each pixel, but the luminance value of each pixel may be the average value of the R, G, B signal values or may be the Y signal value of Y, U, V signal values converted from the R, G, B signal values.

The luminance value calculator 102 further calculates the maximum value among the luminance values of the pixels in each illumination area, and determines the maximum value as the light source luminance value 103 (S201). In the present embodiment, the light source luminance value 103 is the maximum value among the luminance values of the pixels in each illumination area, but the light source luminance value 103 may be a value obtained by multiplying the central value between the maximum and minimum values among lightness values of the pixels in each illumination area by a constant. Alternatively, the light source luminance value 103 may be the average value, mode value, or median value of the luminance values of the pixels in each illumination area.

Next, the luminance distribution calculator 104 estimates the luminance of light incident on each pixel position of the liquid crystal panel 114 when each light source of the backlight 115 irradiates light on the liquid crystal panel 114 in accordance with the light source luminance value 103 (S202).

Concretely, convolution operation as shown in Formula (2) is performed using the light source luminance value 103 of each illumination area and previously given light-emitting luminance distribution of the light source, in order to obtain W(x,y) showing the luminance distribution 105 of the light source at a position (x,y).

$$W(x, y) = \sum_{j=0}^{N-1} \sum_{i=0}^{M-1} P(i, j) \cdot BL_{out}\left(x - \frac{(M-1)}{2} + i, y - \frac{(N-1)}{2} + j\right) \quad (2)$$

(Each of $M$ and $N$ is an odd number)

Note that M and N represent the horizontal size and vertical size of the light-emitting luminance distribution respectively, $BL_{out}(x,y)$ represents the light source luminance of the area including the coordinate (x,y), and P(i,j) represents the luminance value at a position (i,j) in the light-emitting luminance distribution.

Figure 6:
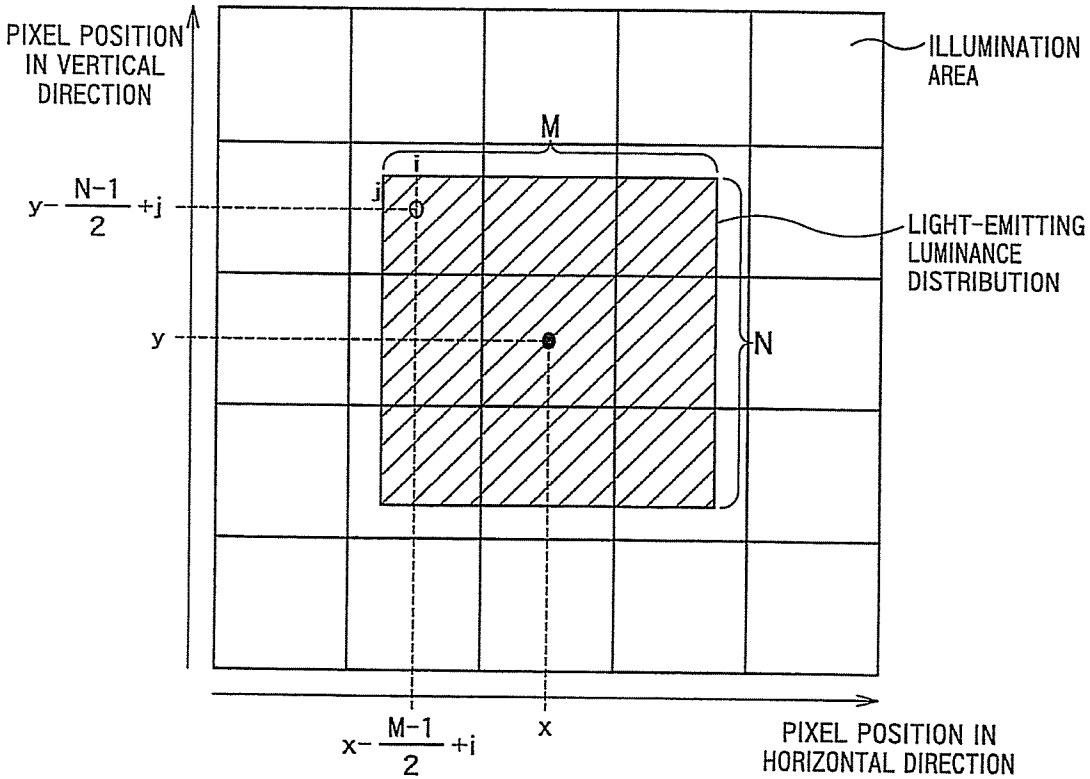
FIG. 6 is a diagram showing an example of the convolution operation performed when estimating the luminance distribution of light incident on each pixel position of a liquid crystal panel.

FIG. 6 shows an example of the convolution operation. In FIG. 6, the position shown with a black circle is the pixel position (x,y) on which the luminance distribution W(x,y) is calculated. The hatched square is light-emitting luminance distribution of M×N. The white circle at the coordinate (i,j) in the light-emitting luminance distribution is expressed as $$\left(x - \frac{(M-1)}{2} + i, y - \frac{(N-1)}{2} + j\right)$$

to show the pixel coordinate in the image. Further, as to the peripheral area of the image, the convolution operation of Formula (2) is performed specularly inverting the light source luminance value 103, by which W(x,y) showing the light source luminance distribution 105 is obtained. Note that the convolution operation of Formula (2) is only an example for calculating the light source luminance distribution, and thus the light source luminance distribution may be calculated by another method.

The light source the luminance distribution 105 calculated by the luminance distribution calculator 104 is inputted into the signal corrector 106.

Next, the gradation saturation estimator 107 calculates, from the input video signal 101, the correction coefficient 108 showing how easily gradation saturation occurs in the input video.

Concretely, the representative value calculator 120 of FIG. 2 performs gamma conversion on the signal values of the R, G, B subpixels forming each pixel of the input video signal 101. The representative value calculator 120 further determines the maximum value among the gamma-converted signal values of R, G, B subpixels of each pixel as the luminance value of each pixel.

In the present embodiment, the maximum value among the R, G, B signal values is determined as the luminance value of each pixel, but the luminance value of each pixel may be the average value of the R, G, B signal values or may be the Y signal value of Y, U, V signal values converted from the R, G, B signal values.

Further, the representative value calculator 120 divides the screen of the input video signal 101 into a plurality of divided areas, and calculates the representative value 121 of the luminance values of the pixels in each divided area (S203).

Here, the representative value may be calculated in an arbitrary size of divided area. For example, the size of the divided area may be the same as the size of the illumination area, or may be one pixel. That is, the size of the divided area can be arbitrarily set on a pixel-by-pixel basis.

When the divided area has the same size as the size of the illumination area, the light source luminance value 103 calculated by the luminance value calculator 102 may be used directly as the representative value 121.

Next, the differential value calculator 122 calculates the average value of the representative values 121 of all of the divided areas, specifies the maximum value among the representative values 121 of all of the divided areas, and calculates the differential value 123 between the maximum value and the average value (S204).

The average value may be a weighted average value of the representative values of all of the divided areas, or may be a value obtained by performing a weighted smoothing process based on a Gaussian filter etc. on the representative value of the area having the maximum value.

Further, the differential value 123 is calculated by subtracting the average value from the maximum value. As another calculation method, it is also possible to calculate the differential value 123 by dividing the maximum value by the average value.

When the differential value 123 is large, the pixel values are widely distributed. In this case, if the light source emits light having the luminance level of any one of the widely distributed pixel values, gradation saturation easily occurs since the error between the light-emitting luminance of the light source and the luminance value of the pixel becomes large. On the other hand, when the differential value 123 is small, the pixel values are narrowly distributed, and the pixel values become similar to one another as a whole. In this case, gradation saturation hardly occurs since the error between the light-emitting luminance of the light source and the luminance of the input signal value becomes small.

Next, the correction coefficient calculator 124 calculates, from the differential value 123, a correction coefficient for correcting the expanded signal (S205). As stated above, the correction coefficient calculator 124 sets the correction coefficient 108 smaller as the differential value 123 becomes larger (as gradation saturation occurs more easily). On the other hand, the correction coefficient calculator 124 sets the correction coefficient 108 larger as the differential value 123 becomes smaller (as gradation saturation occurs more hardly). One correction coefficient is set for one frame of the input video signal 101.

Figure 7:
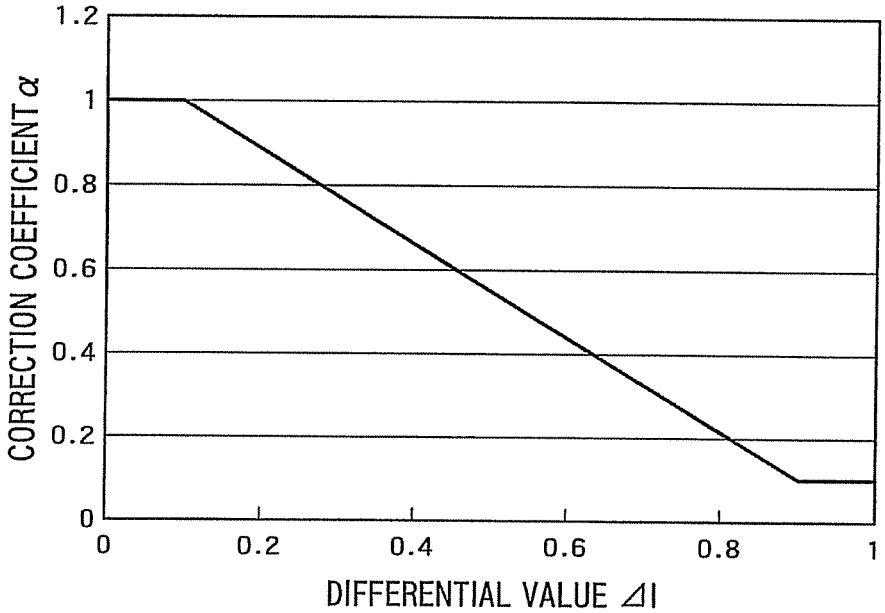
FIG. 7 is a diagram showing an example of how to obtain a correction coefficient.

FIG. 7 shows an example of the relationship between the differential value 123 and the correction coefficient 108.

As shown in FIG. 7, the correction coefficient 108 is set smaller as the differential value 123 becomes larger (as gradation saturation occurs more easily). On the other hand, the correction coefficient 108 is set larger as the differential value 123 becomes smaller (as gradation saturation occurs more hardly). As the correction coefficient 108 becomes smaller, the signal value is greatly required to be reduced in the correction performed by the signal corrector 106, as will be explained later.

The relationship between the differential value 123 and the correction coefficient 108 as shown in FIG. 7 is only an example, and thus the relationship therebetween is not limited to the example of FIG. 7.

The correction coefficient calculator 124 calculates the correction coefficient 108 by referring to a lookup table retaining the relationship between the differential value 123 and the correction coefficient 108 as shown in FIG. 7.

Next, the signal corrector 106 of FIG. 1 obtains the corrected video signal 109 by expanding and correcting the input video signal 101 in accordance with the luminance distribution 105 and the correction coefficient 108.

Concretely, first, the signal expander 130 of FIG. 3 expands the input video signal 101 in accordance with the luminance distribution 105 (S206). RGB values (after gamma conversion is performed thereon) of the pixel at a position (x,y) in the input video signal 101 are defined as $R_{in}(x,y)$, $G_{in}(x,y)$, and $B_{in}(x,y)$ respectively. Generally, RGB values $D_R(x,y)$, $D_G(x,y)$, $D_B(x,y)$ displayed on the liquid crystal panel 114 are expressed as shown in Formula (3) using $T_R(x,y)$, $T_G(x,y)$, and $T_B(x,y)$ each showing the transmittance of the liquid crystal panel 114 with respect to each color component when the position (x,y) in the luminance distribution 105 has the luminance value W(x,y).

$$D_R(x,y)=T_R(x,y)\times W(x,y)$$
$$D_G(x,y)=T_G(x,y)\times W(x,y) \quad (3)$$
$$D_B(x,y)=T_B(x,y)\times W(x,y)$$

$D_R(x,y)=R_{in}(x,y)$, $D_G(x,y)=G_{in}(x,y)$, and $D_B(x,y)=B_{in}(x,y)$, and thus $R_{in}(x,y)$, $G_{in}(x,y)$, and $B_{in}(x,y)$ are expressed as shown in Formula (4).

$$R_{in}(x,y)=T_R(x,y)\times W(x,y)$$
$$G_{in}(x,y)=T_G(x,y)\times W(x,y) \quad (4)$$
$$B_{in}(x,y)=T_B(x,y)\times W(x,y)$$

Therefore, expanded transmittance $R_{TR}(x,y)$, $G_{TR}(x,y)$, and $B_{TR}(x,y)$ for displaying $R_{in}(x,y)$, $G_{in}(x,y)$, and $B_{in}(x,y)$ are calculated as shown in Formula (5).

$$R_{TR}(x,y)=\frac{R_{in}(x,y)}{W(x,y)} \quad (5)$$
$$G_{TR}(x,y)=\frac{G_{in}(x,y)}{W(x,y)}$$
$$B_{TR}(x,y)=\frac{B_{in}(x,y)}{W(x,y)}$$

The corrected transmittance may be obtained by Formula (5), or by referring to a previously prepared lookup table determining the correspondence between the input signal value and the light source luminance distribution value and the transmittance.

Signal values of the expanded video 131 displayed on the liquid crystal panel 114 in accordance with the expanded transmittance ($R_{TR}(x,y)$, $G_{TR}(x,y)$, $B_{TR}(x,y)$) are defined as ($R_{out}(x,y)$, $G_{out}(x,y)$, $B_{out}(x,y)$). The signal value $R_{out}(x,y)$ of the expanded video 131 is obtained by performing inverse gamma conversion on the expanded transmittance $R_{TR}(x,y)$ as shown in Formula (6). (The same can be applied to $G_{out}(x,y)$ and $B_{out}(x,y)$.)

$$R_{out}(x,y)=(R_{TR}(x,y))^{\frac{1}{\gamma}}\times 255 \quad (6)$$

Next, the gradation corrector 132 calculates the corrected video signal 109 by correcting the expanded video signal 131 in accordance with the correction coefficient 108 (S207).

Three examples will be shown in the following as to a concrete correction method.

In a first correction example, a lookup table previously retains a plurality kinds of correction gradation characteristics each representing the gradation characteristic between the expanded video signal 131 and the corrected video signal 109. A correction gradation characteristic is selected from the lookup table depending on the correction coefficient in order to calculate a corrected signal value $R'_{out}(x,y)$ in accordance with the selected correction gradation characteristic, as shown in Formula (7).

$$R'_{out}(x,y)=LUT_{\alpha}(R_{out}(x,y)) \quad (7)$$

Note that $LUT_{\alpha}$ is a correction gradation characteristic representing the relationship between the expanded video signal 131 and the corrected video signal 109 when the correction coefficient 108 is $\alpha$.

Figure 8:
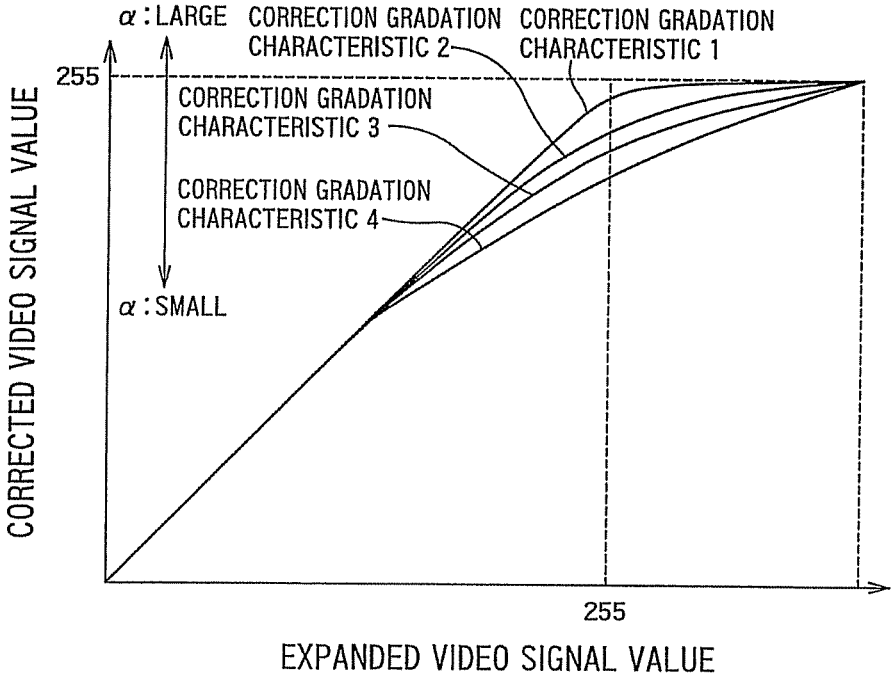
FIG. 8 is a diagram showing an example for selecting a correction gradation characteristic to be used depending on the value of the correction coefficient.

FIG. 8 shows examples of correction gradation characteristics. In the example of FIG. 8, the LUT retains four different kinds of correction gradation characteristics.

In the example of FIG. 8, the inclination of each of correction gradation characteristics 1 to 4 becomes more gradual as the expanded video signal value becomes larger. The corrected video signal value related to the expanded video signal value becomes smaller in this order of the correction gradation characteristics 1, 2, 3, and 4. In all of the characteristics, the maximum value of the expanded video signal is related to the same value of the corrected video signal (maximum value).

In the correction gradation characteristic 1, the relationship between the corrected video signal value and the expanded video signal value is approximately 1:1 when the expanded video signal value is smaller than 255, and gradation saturation easily occurs when the expanded video signal value becomes 255 or greater since the corrected video signal value becomes nearly 255 at this time.

On the other hand, the correction gradation characteristic 4 is provided to correct gradation by reducing the corrected video signal value to keep gradation quality, and is capable of reducing gradation saturation even when the expanded video signal value is large.

A plurality of different gradation characteristics such as the correction gradation characteristic 1 to 4 are retained in a lookup table in order to select a gradation characteristic closer to the correction gradation characteristic 1 as the correction coefficient $\alpha$ becomes larger and to select a gradation characteristic closer to the correction gradation characteristic 4 as the correction coefficient $\alpha$ becomes smaller.

FIG. 8 shows four kinds or correction gradation characteristics, but it is also possible to retain more correction gradation characteristics in a lookup table in order to obtain a correction gradation characteristic corresponding to the value of the correction coefficient $\alpha$ with higher fineness.

Figure 9:
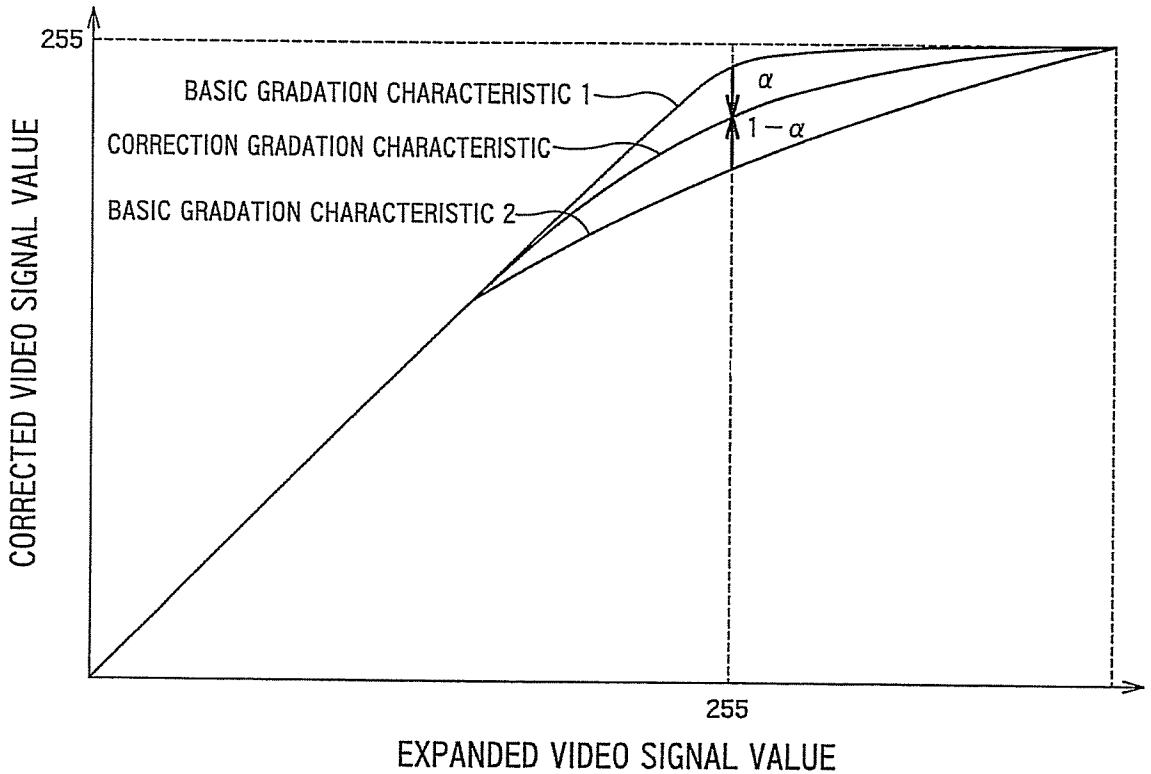
FIG. 9 is a diagram showing an example for calculating the correction gradation characteristic by synthesizing a plurality of basic gradation characteristics each being weighted depending on the value of the correction coefficient.

In a second correction example, a plurality of basic gradation characteristics are previously prepared. Then, as shown in FIG. 9, a correction gradation characteristic is acquired by synthesizing these basic gradation characteristics each being weighted depending on the value of the correction coefficient α. The corrected video signal is calculated, from the expanded video signal, in accordance with this correction gradation characteristic.

In the case of FIG. 9, a lookup table retains two kinds of basic gradation characteristics, namely basic gradation characteristic 1 and basic gradation characteristic 2. The expanded video signal value of the basic gradation characteristic 1(one gradation characteristic data in the two gradation characteristic data) is related to a corrected video signal value larger than that of the basic gradation characteristic 2 (the other gradation characteristic data).

An correction gradation characteristic is acquired by synthesized these two basic gradation characteristics using the correction coefficient α, as shown in Formula (8). The corrected video signal value is calculated by giving the expanded video signal to this correction gradation characteristic.

That is, when the corrected signal value for the expanded video signal value $R_{out}(x,y)$ in the basic gradation characteristic 1 is defined as $LUT1(R_{out}(x,y))$, and the corrected signal value for the expanded video signal value $R_{out}(x,y)$ in the basic gradation characteristic 2 is defined as $LUT2(R_{out}(x,y))$, the corrected video signal value $R'_{out}(x,y)$ is calculated as shown in Formula (8).

$$R'_{out}(x,y)=\alpha\times LUT1(R_{out}(x,y))+(1-\alpha)\times LUT2(R_{out}(x,y)) \quad (8)$$

In Formula (8), the weight for the basic gradation characteristic 1 is defined as α, and the weight for the basic gradation characteristic 2 is defined as 1−α. It is also possible to define the weight for the basic gradation characteristic 1 as α and to define the weight for the basic gradation characteristic 2 as K−α, depend on the calculation method of the correction coefficient α. K is an arbitrary constant larger than α.

As stated above, in the second correction example, the correction gradation characteristic is calculated by synthesizing the basic gradation characteristics. This makes it possible to calculate a corrected video signal depending on the correction coefficient α even when the lookup table does not retain a large amount of correction gradation characteristics.

In the example of FIG. 9, two basic gradation characteristics are provided, but three or more basic gradation characteristics may be retained. In this case, two basic gradation characteristics are selected from the basic gradation characteristics depending on the value of α, and the two selected basic gradation characteristics are synthesized as shown in Formula (8) to calculate the correction gradation characteristic.

In a third correction method, the corrected video signal value $R'_{out}(x,y)$ is calculated by multiplying the expanded video signal value $R_{out}(x,y)$ by the correction coefficient α, as shown in Formula (9). Therefore, the expanded video signal is corrected to have a smaller value as the value of the correction coefficient α becomes smaller, and the expanded video signal is corrected to have a larger value as the value of the correction coefficient α becomes larger.

$$R'_{out}(x,y)=\alpha\times R_{out}(x,y) \quad (9)$$

The corrected video signal 109 calculated by the signal corrector 106 is inputted into the liquid crystal controller 110.

The light source controller 112 generates the light source control signal 113 for controlling the backlight 115 so that each light source emits light having luminance depending on the light source luminance value 103, and the light source control signal 113 is transmitted to the backlight 115. The backlight 115 lets each light source emit light in accordance with the light source control signal 113 (S208).

The liquid crystal controller 110 generates a liquid crystal control signal 111 for controlling the liquid crystal panel 114 in order to perform modulation on a pixel-by-pixel basis depending on the corrected video signal 109, and transmits the liquid crystal control signal 111 to the liquid crystal panel 114. The liquid crystal panel 114 displays an image in the display area on the liquid crystal panel 114 by modulating the light from the backlight 115 on a pixel-by-pixel basis, depending on the liquid crystal control signal 111 (S208).

Here, effects of the present embodiment will be explained using FIG. 10 to FIG. 13.

Figure 10:
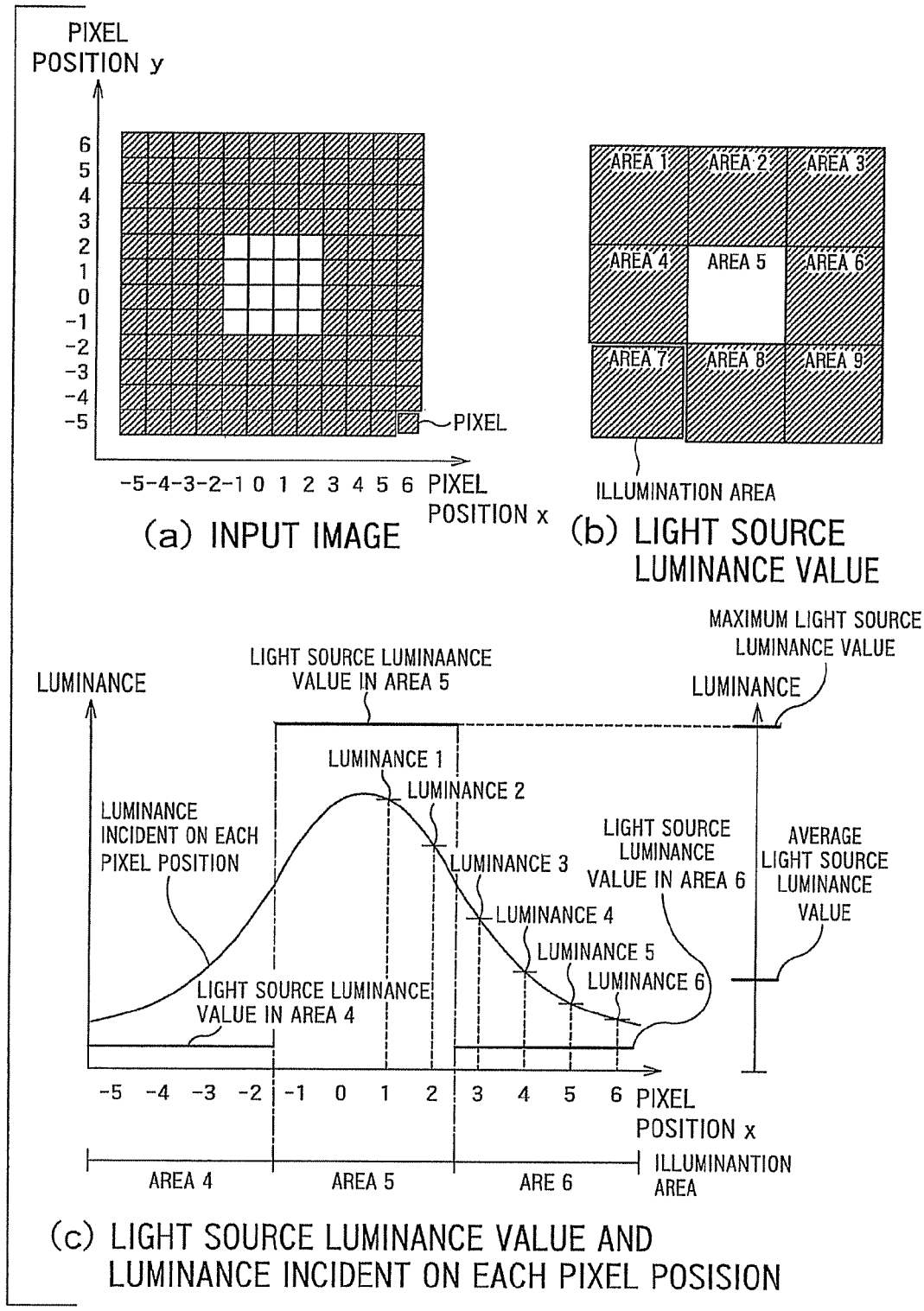
FIG. 10 is a diagram explaining an effect of the first embodiment using an example of an input image having high signal values in its central area and having low signal values in its peripheral areas.

FIG. 10(*a*) shows an input image formed of 12 pixels in the horizontal direction×12 pixels in the vertical direction.

Corresponding to the input image FIG. 10(*a*), a backlight having 9 light sources of 3 in the horizontal direction×3 in the vertical direction will be assumed. The entire image is divided into 9 areas and each illumination area has pixels of 4 in the horizontal direction×4 in the vertical direction. FIG. 10(*b*) shows how the light source luminance value is set in each illumination area. The maximum value in the pixels in each illumination area is set as the light source luminance value of each illumination area. The light source luminance in area 5 is high, while the light source luminance in its peripheral areas is low.

When the light source luminance values are set as shown in FIG. 10(*b*), the luminance of each light source emitting light at a pixel position of y=0 in the horizontal direction of the liquid crystal panel becomes as shown in FIG. 10(*c*). Since the peripheral areas have light source luminance values lower than the light source luminance value of the area 5, the luminance actually incident on each pixel positions in the area 5 of the liquid crystal panel is largely reduced compared to the light source luminance value, and thus gradation saturation easily occurs.

Figure 11:
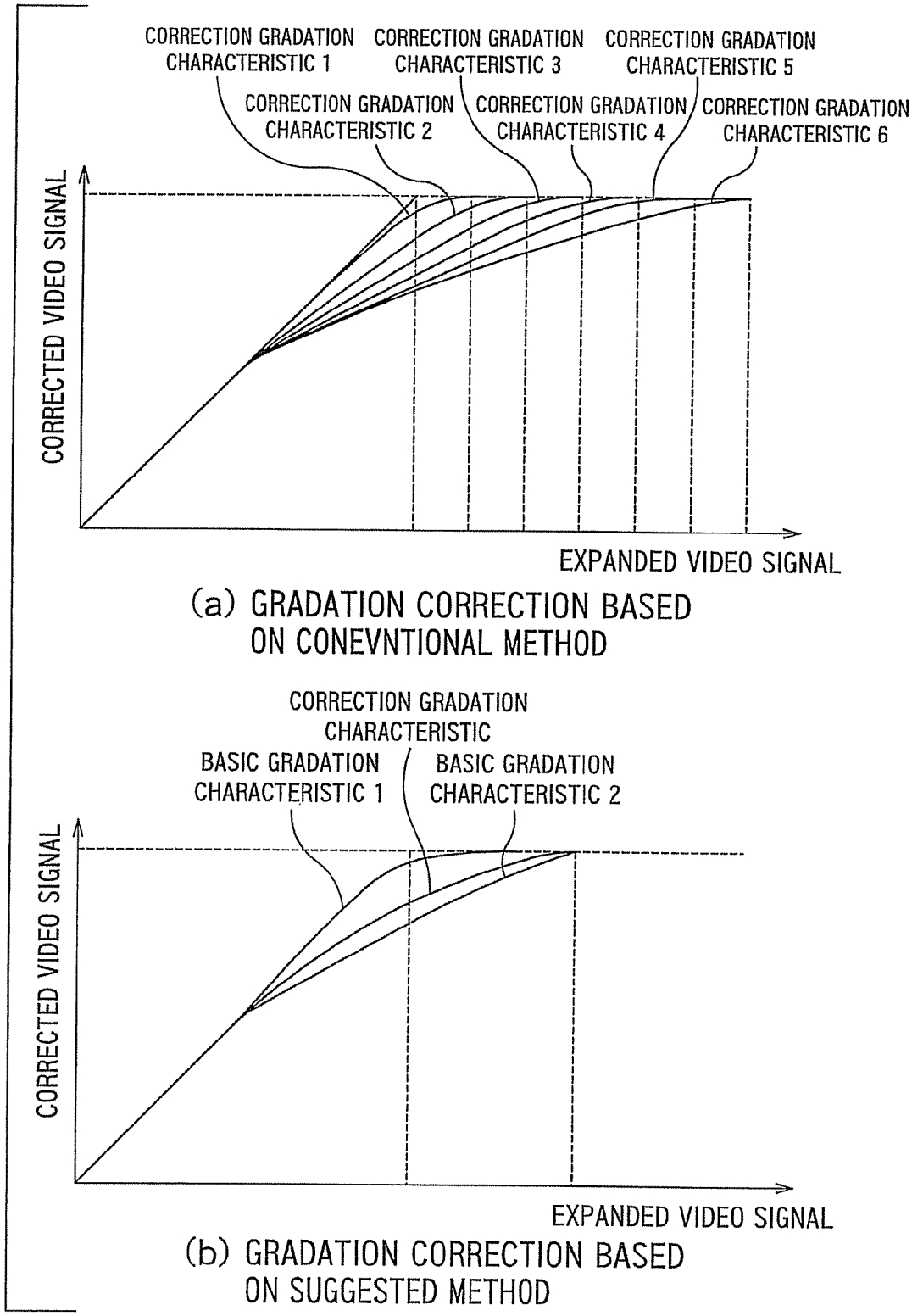
FIG. 11 is a diagram showing an effect of the first embodiment in the case of the input image exampled in FIG. 10.

In the conventional technique, a gradation characteristic is calculated depending on the expansion gain determined by the light source luminance incident on the liquid crystal panel. Since the light source luminance incident on each pixel position is different, the expansion gain differs depending on each pixel position. Accordingly, the gradation characteristic must be calculated with respect to each expansion gain differing depending on each pixel. In such a case, when the light sources emit light having the light source luminance as shown in FIG. 10(*b*) with respect to the input image of FIG. 10(*a*), it is necessary to calculate gradation characteristics 1 to 6 depending on luminance 1 to 6 at pixel positions 1 to 6, as shown in FIG. 11(*a*). When the number of pixels is large, computing amount becomes enormous since gradation characteristics corresponding to the number of pixels must be calculated (by performing nonlinear operation).

On the other hand, in the suggested method, it is required to calculate only one correction gradation characteristic for one image. For example, in the second correction example, one correction coefficient α for one image is calculated from the differential value between the maximum value and average value among the light source luminance values in all of the divided areas. Then, the correction gradation characteristic is obtained by synthesizing the basic gradation characteristic 1 easily causing gradation saturation and the basic gradation characteristic 2 hardly causing gradation saturation, based on the correction coefficient α. This correction gradation characteristic is used to correct all of the expanded signals. In this way, an image having reduced gradation saturation can be displayed with a small computing amount while restraining the reduction in the luminance of the entire screen as much as possible. Concretely, in the example of FIG. 10, the differential value between the input image and the light source luminance value is large, and thus it is estimated that gradation saturation easily occurs and then the correction coefficient α is set small. As a result, as shown in FIG. 11(*b*), one correction gradation characteristic is calculated to be close to the basic gradation characteristic 2 hardly causing gradation saturation. In this way, the input image as shown in FIG. 10(*a*) is corrected reducing the luminance of the entire screen, but the image can be displayed while restraining the clipping of gradation and reducing gradation saturation.

The second correction example is used in the above explanation, but the first correction example or the third correction example may be used instead.

Figure 12:
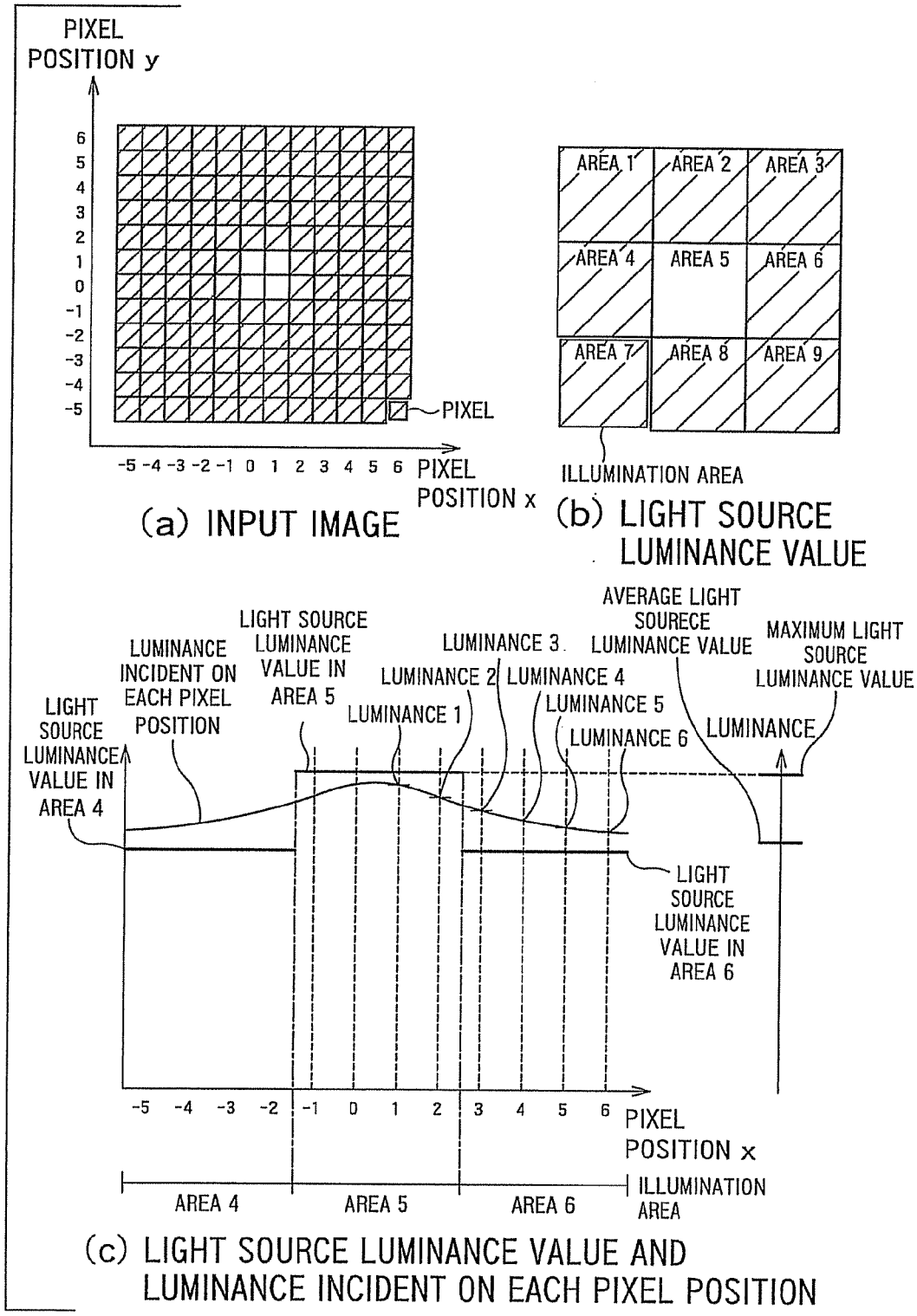
FIG. 12 is a diagram explaining an effect of the first embodiment using an example of an input image having high signal values in the entire area.

As another example, an input image as shown in FIG. 12(*a*) will be considered. Signal values of the input image of FIG. 12(*a*) are high as a whole, and pixels around the center has particularly high signal values.

Similarly to FIG. 10, FIG. 12(*b*) shows how the light source luminance value is set in each illumination area. Although the light source luminance in the area 5 is high, the luminance in its peripheral areas is sufficiently large compared to FIG. 10(*b*). FIG. 12(*c*) shows the luminance incident on each pixel position of the liquid crystal panel when the light sources actually emit light with the light source luminance values of FIG. 12(*b*). Since the light source luminance incident on each pixel position of the liquid crystal panel is high as a whole and the error between the input image and the light source luminance value is small, gradation saturation hardly occurs.

Figure 13:
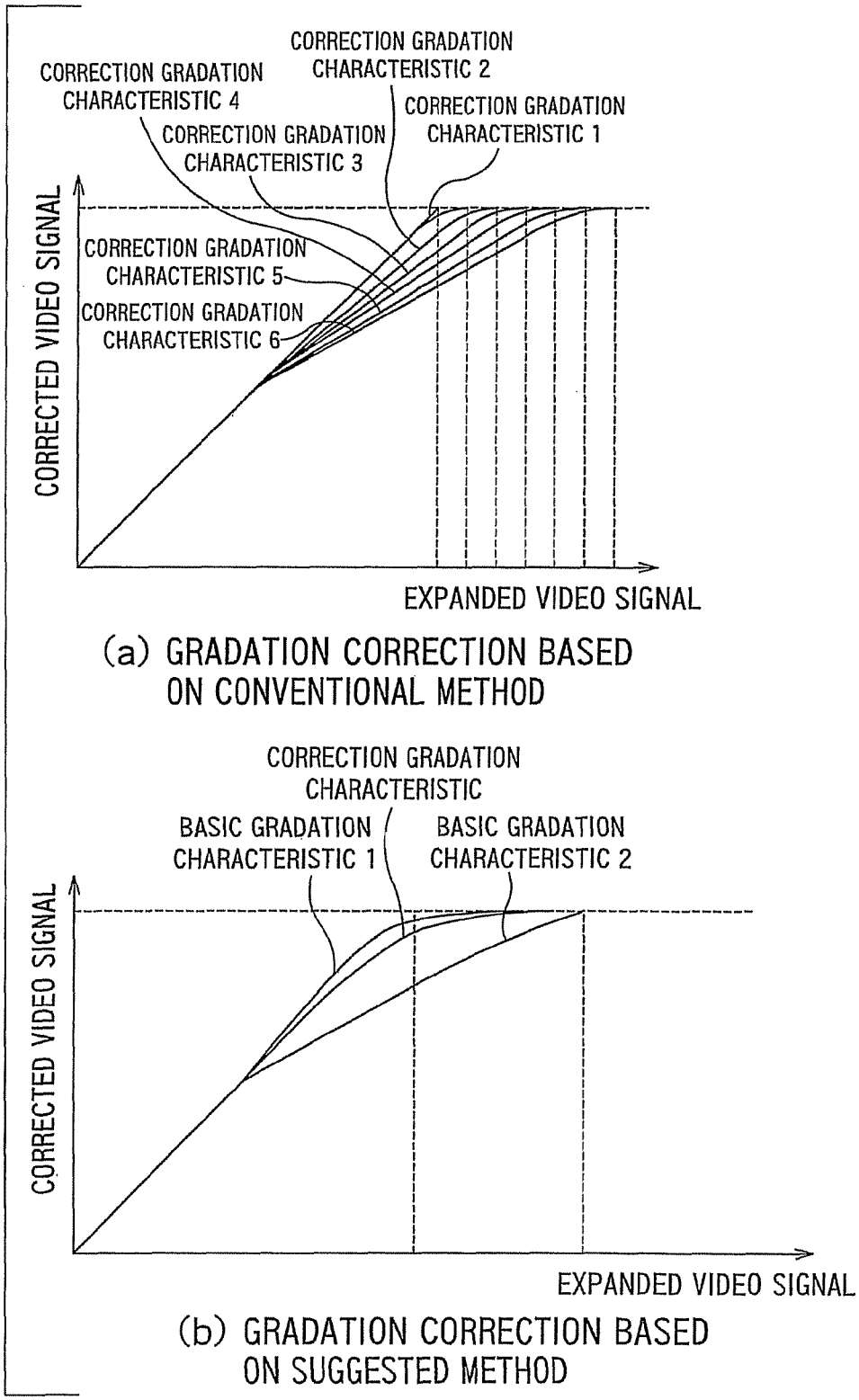
FIG. 13 is a diagram showing an effect of the first embodiment in the case of the input image exampled in FIG. 12.

In the case of FIG. 12(*c*), when calculating a gradation characteristic with respect to each expansion gain as in the conventional technique, gradation characteristics 1 to 6 for pixel positions 1 to 6 must be calculated depending on luminance 1 to 6 respectively, as shown in FIG. 13(*a*). When the number of pixels is large, computing amount becomes enormous since gradation characteristics corresponding to the number of pixels must be calculated.

On the other hand, in the suggested method, one correction gradation characteristic is calculated for one image, and all of the expanded signals are corrected using this correction gradation characteristic, as stated above. In this way, an image having reduced gradation saturation can be displayed with a small computing amount while restraining the reduction in the luminance of the entire screen as much as possible. Concretely, in FIG. 12(*b*), the maximum value and average value of the light source luminance values are close to each other, and thus it is estimated that gradation saturation hardly occurs and then the correction coefficient α is set to have a value closer to 1. As a result, a correction gradation characteristic as shown in FIG. 13(*b*) is obtained by synthesizing the basic gradation characteristic 1 easily causing gradation saturation and the basic gradation characteristic 2 hardly causing gradation saturation so that the correction gradation characteristic gets closer to the basic gradation characteristic 1. In other words, with respect to the input image as shown in FIG. 12(*a*), even when a correction gradation characteristic close to the basic gradation characteristic 1 easily causing gradation saturation is used, an image having restrained gradation saturation can be displayed while restraining the reduction in the luminance of the entire screen.

As stated above, according to the present embodiment, the expanded video signal is corrected to have a smaller value as the differential value of the image becomes larger (as gradation saturation occurs more easily), by which an image having a large differential value is corrected reducing the luminance of the entire screen but the image can be displayed reducing gradation saturation. Further, the image having a large differential value can be displayed with restrained gradation saturation while restraining the reduction in the luminance of the entire screen.

In the present embodiment, only one correction gradation characteristic should be calculated for one input image, and thus there is no need to perform the operation for obtaining a correction gradation characteristic with respect to each pixel as in the conventional technique. Therefore, a high contrast image can be easily displayed with restrained gradation saturation, without performing an enormous amount of computing.

Second Embodiment

Figure 14:
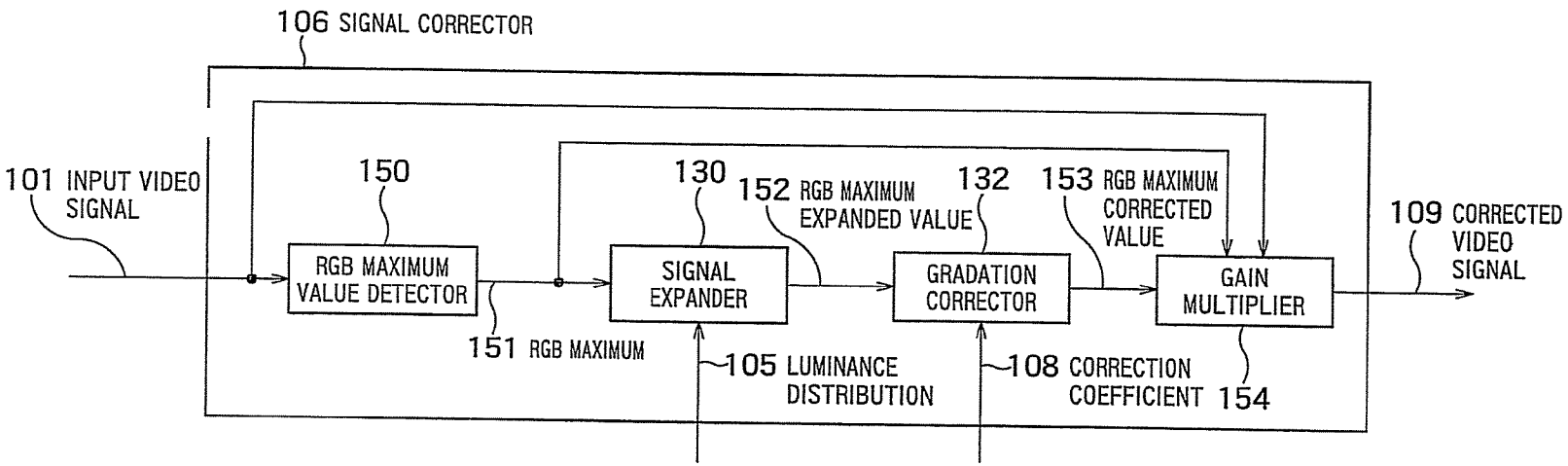
FIG. 14 is a diagram showing the structure of a signal corrector according to a second embodiment.

FIG. 14 shows the signal corrector 106 according to the present embodiment. In addition to the components of the first embodiment, the signal corrector 106 further includes an RGB maximum value detector 150 and a gain multiplier 154. The elements having the same names as those of FIG. 3 are given the same symbols, and overlapping explanation will be omitted if not relating to an expand process.

The RGB maximum value detector 150 detects a subpixel having the highest signal value among the signal values of R, G, B subpixels forming each pixel of the input video signal 101. The RGB maximum value detector 150 defines the signal value of the detected subpixel as an RGB maximum value 151, and transmits it to the signal expander 130 and the gain multiplier 154.

In the first embodiment, the signal expander 130 expands the signal values of all of the subpixels of each pixel. In the present embodiment, only the RGB maximum value 151 of each pixel is expanded, and an RGB maximum expanded value 152 is transmitted to the gradation corrector 132.

More specifically, the signal expander 130 performs gamma conversion on the RGB maximum value 151, and expands the gamma-converted RGB maximum value 151 in accordance with the luminance distribution 105, similarly to the first embodiment. The signal expander 130 performs inverse gamma conversion on the expanded RGB maximum value, and inputs the inversely gamma-converted value into the gradation corrector 132 as the RGB maximum expanded value 152.

The gradation corrector 132 calculates an RGB maximum corrected value 153 by correcting the RGB maximum expanded value 152 in accordance with a correction gradation characteristic selected from a lookup table depending on the correction coefficient 108, and the RGB maximum corrected value 153 is transmitted to a gain multiplier 154. The correction gradation characteristic may be calculated by synthesizing two basic gradation characteristics each being weighted depending on the correction coefficient α. Further, the correction gradation characteristic may be calculated by selecting two basic gradation characteristics depending on the correction coefficient α from a plurality of basic gradation characteristics stored in a lookup table, and by synthesizing the two selected basic gradation characteristics each being weighted depending on the correction coefficient α. The RGB maximum corrected value 153 may be calculated by multiplying the RGB maximum expanded value 152 by the correction coefficient 108. The operation performed by the gradation corrector 132 is already explained in detail in the first embodiment, and thus further explanation thereof will be omitted.

The gain multiplier 154 calculates the corrected video signal 109 using the proportion of the RGB maximum corrected value 153 to the RGB maximum value 151, as shown in Formula (10).

$$R_{out}(x) = \frac{MAX_{out}(x)}{MAX_{in}(x)} \times R_{in}(x) \quad (10)$$

$$G_{out}(x) = \frac{MAX_{out}(x)}{MAX_{in}(x)} \times G_{in}(x)$$

$$B_{out}(x) = \frac{MAX_{out}(x)}{MAX_{in}(x)} \times B_{in}(x)$$

Note that the input video signal 101 is represented as ($R_{in}$, $G_{in}$, $B_{in}$), the corrected video signal 109 is represented as ($R_{out}$, $G_{out}$, $B_{out}$), the RGB maximum value 151 is represented as $MAX_{in}$, and the RGB maximum corrected value 153 is represented as $MAX_{out}$.

Figure 15:
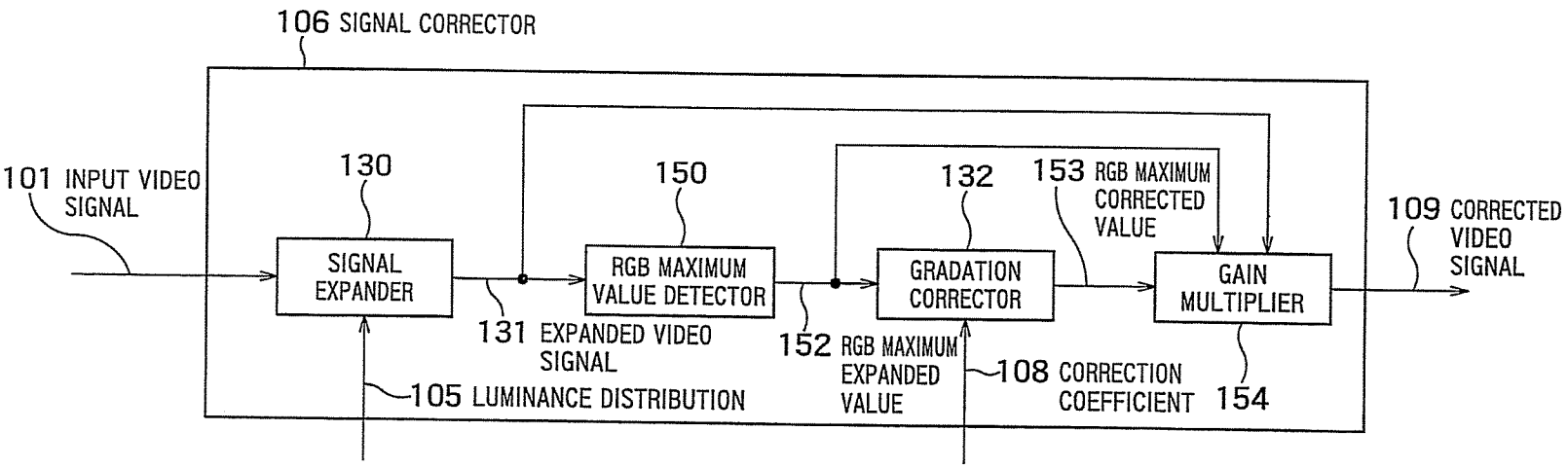
FIG. 15 is a diagram showing a modification example of the signal corrector of FIG. 14.

FIG. 15 shows a modification example of FIG. 14, and the RGB maximum value detector 150 is arranged between the signal expander 130 and the gradation corrector 132. The elements having the same names as those of FIG. 14 are given the same symbols, and overlapping explanation will be omitted if not relating to an expanded process.

In this case, the signal expander 130 performs gamma conversion on the signal values of all of the subpixels forming each pixel of the input video signal 101, and expands the gamma-converted signal in accordance with the luminance distribution 105. The signal expander 130 acquires the expanded video signal 131 by performing inverse gamma conversion on the expanded signal, and inputs the expanded video signal 131 into the RGB maximum value detector 150 and the gain multiplier 154.

The RGB maximum value detector 150 detects a subpixel having the highest signal value among the signal values of RGB subpixels forming each pixel of the expanded video signal 131. The RGB maximum value detector 150 defines the signal value of the detected subpixel as the RGB maximum expanded value 152, and inputs it into the gradation corrector 132 and the gain multiplier 154.

The gradation corrector 132 calculates the RGB maximum corrected value 153 by correcting the RGB maximum expanded value 152 in accordance with a correction gradation characteristic selected from a lookup table depending on the correction coefficient 108, and the RGB maximum corrected value 153 is transmitted to a gain multiplier 154. The correction gradation characteristic may be acquired by synthesizing two basic gradation characteristics each being weighted depending on the correction coefficient 108. Further, the correction gradation characteristic may be acquired by selecting two basic gradation characteristics depending on the correction coefficient 108 from a plurality of basic gradation characteristics stored in a lookup table, and by synthesizing the two selected basic gradation characteristics each being weighted depending on the correction coefficient 108. The RGB maximum corrected value 153 may be calculated by multiplying the RGB maximum expanded value 152 by the correction coefficient 108. The operation performed by the gradation corrector 132 is already explained in detail in the first embodiment, and thus further explanation thereof will be omitted.

The gain multiplier 154 calculates the corrected video signal 109 using the proportion of the RGB maximum corrected value 153 to the RGB maximum expanded value 152, as shown in Formula (11).

$$R_{out}(x) = \frac{MAX'_{out}(x)}{MAX'_{in}(x)} \times R'_{in}(x) \quad (11)$$

-continued $$G_{out}(x) = \frac{MAX'_{out}(x)}{MAX'_{in}(x)} \times G'_{in}(x)$$

$$B_{out}(x) = \frac{MAX'_{out}(x)}{MAX'_{in}(x)} \times B'_{in}(x)$$

Note that the expanded video signal 131 is represented as ($R'_{in}$, $G'_{in}$, $B'_{in}$), the corrected video signal 109 is represented as ($R_{out}$, $G_{out}$, $B_{out}$), the RGB maximum expanded value 152 is represented as $MAX'_{in}$, and the RGB maximum corrected value 153 is represented as $MAX'_{out}$.

As stated above, according to the present embodiment, the proportion of RGB colors of the corrected video signal 109 becomes the same as the proportion of RGB colors of the input video signal 101, and thus an image having restrained gradation saturation can be displayed without causing color drift in the input image.

The invention claimed is:

1. A liquid crystal display comprising:

a backlight having a plurality of light sources, each of the light source being controllable respectively;

a liquid crystal panel in front of the backlight to display a video in a display area;

a luminance value calculator configured to calculate light source luminance values of the light sources based on an input video signal including signal values of a plurality of pixels;

a luminance distribution calculator configured to calculate luminance distribution of light in illumination areas obtained by tentatively dividing the display area if the light sources emit light according to the light source luminance values;

a representative value calculator configured to calculate, based on the input video signal, a representative luminance value in each of a plurality of divided areas obtained by tentatively dividing the display area; and a signal corrector configured to calculate a corrected video signal by correcting the input video signal according to a difference between a maximum value of the representative luminance values and an average value of the representative luminance values based on the luminance distribution calculated by the luminance distribution calculator, wherein the signal corrector expands the input video signal depending on the luminance distribution, selects a gradation characteristic data depending on the difference, from a plurality of gradation characteristic data each relating a value of the expanded video signal to a value of the corrected video signal, and corrects the expanded video signal in accordance with a selected gradation characteristic data to obtain the corrected video signal.

2. The device of claim 1, wherein the signal corrector selects the gradation characteristic data so that the expanded video signal is corrected to have a smaller value as the difference becomes larger.

3. The device of claim 1, wherein the difference is a value obtained by subtracting the average value of the representative luminance values from the maximum value among the representative luminance values, or a value obtained by dividing the maximum value among the representative luminance values by the average value of the representative luminance values.

4. A liquid crystal display comprising:

a backlight having a plurality of light sources, each of the light source being controllable respectively;

a liquid crystal panel in front of the backlight to display a video in a display area;

a luminance value calculator configured to calculate light source luminance values of the light sources based on an input video signal including signal values of a plurality of pixels;

a luminance distribution calculator configured to calculate luminance distribution of light in illumination areas obtained by tentatively dividing the display area if the light sources emit light according to the light source luminance values;

a representative value calculator configured to calculate, based on the input video signal, a representative luminance value in each of a plurality of divided areas obtained by tentatively dividing the display area; and a signal corrector configured to calculate a corrected video signal by correcting the input video signal according to a difference between a maximum value of the representative luminance values and an average value of the representative luminance values based on the luminance distribution calculated by the luminance distribution calculator, wherein the signal corrector uses two gradation characteristic data each relating a value of the expanded video signal to a value of the corrected video signal, and obtains the corrected video signal by summing values of the corrected video signals obtained from the two gradation characteristic data, the values being weighted with weights determined depending on the difference, one of the two gradation characteristic data relates the value of the expanded video signal to a larger corrected video signal than the corrected video signal of the other gradation characteristic data, and the signal corrector sets the weight for the one gradation characteristic data smaller and sets the weight for the other gradation characteristic data larger as the difference becomes larger.

5. The device of claim 4, wherein the signal corrector obtains a correction coefficient having a value which becomes smaller as the difference becomes larger, and sets the weight for the one gradation characteristic data to the value of the correction coefficient while setting the weight for the other gradation characteristic data to a value obtained by subtracting the value of the correction coefficient from a predetermined value.

6. The device of claim 5, wherein the signal corrector selects the two gradation characteristic data from three or more gradation characteristic data, based on the correction coefficient.

7. The device of claim 4, wherein the difference is a value obtained by subtracting the average value of the representative luminance values from the maximum value among the representative luminance values, or a value obtained by dividing the maximum value among the representative luminance values by the average value of the representative luminance values.

8. A liquid crystal display comprising:

a backlight having a plurality of light sources, each of the light source being controllable respectively;

a liquid crystal panel in front of the backlight to display a video in a display area;

a luminance value calculator configured to calculate light source luminance values of the light sources based on an input video signal including signal values of a plurality of pixels;

a luminance distribution calculator configured to calculate luminance distribution of light in illumination areas obtained by tentatively dividing the display area if the light sources emit light according to the light source luminance values;

a representative value calculator configured to calculate, based on the input video signal, a representative luminance value in each of a plurality of divided areas obtained by tentatively dividing the display area; and a signal corrector configured to calculate a corrected video signal by correcting the input video signal according to a difference between a maximum value of the representative luminance values and an average value of the representative luminance values based on the luminance distribution calculated by the luminance distribution calculator, wherein the signal value of the pixel includes signal values of an R subpixel, a G subpixel, and a B subpixel, the signal corrector corrects the signal value of a maximum subpixel having a largest signal value in the R, G, B subpixels based on the luminance distribution and the difference, and the signal corrector corrects the signal values of the other two subpixels by multiplying the signal values by a proportion of the corrected signal value of the maximum subpixel to the signal value of the maximum subpixel.

9. The device of claim 8, wherein the difference is a value obtained by subtracting the average value of the representative luminance values from the maximum value among the representative luminance values, or a value obtained by dividing the maximum value among the representative luminance values by the average value of the representative luminance values.

* * * * *